US008650711B1

(12) United States Patent
Chen et al.

(10) Patent No.: US 8,650,711 B1
(45) Date of Patent: Feb. 18, 2014

(54) HINGE ASSEMBLY WITH DAMPING DEVICE

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Ting-Tsai Huang, Kaohsiung (TW); Yi-Syuan Jhao, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 13/734,068

(22) Filed: Jan. 4, 2013

(51) Int. Cl.
*E05D 7/04* (2006.01)
*E05D 11/00* (2006.01)
*E05D 11/10* (2006.01)

(52) U.S. Cl.
USPC ..... 16/54; 16/286; 16/296

(58) Field of Classification Search
USPC ..... 16/54, 286, 282, 284, 288, 296
See application file for complete search history.

(56) References Cited

U.S. PATENT DOCUMENTS 5,269,043 A * 12/1993 Yang ..... 16/68
5,617,612 A * 4/1997 Ferrari et al. ..... 16/278
6,622,343 B2 * 9/2003 Rupprechter ..... 16/242
6,845,544 B2 * 1/2005 Hofer ..... 16/246
6,880,205 B2 * 4/2005 Rupprechter ..... 16/235
6,918,158 B2 * 7/2005 Isele ..... 16/235
7,065,833 B2 * 6/2006 Kropf ..... 16/286
7,552,509 B2 * 6/2009 Chen et al. ..... 16/50
7,591,044 B2 * 9/2009 Migli ..... 16/235
7,653,967 B2 * 2/2010 Lowe et al. ..... 16/238
7,695,080 B2 * 4/2010 Chen et al. ..... 312/333
7,730,582 B2 * 6/2010 Migli ..... 16/286
7,731,142 B2 * 6/2010 Chen et al. ..... 248/244
7,878,468 B2 * 2/2011 Chen et al. ..... 248/220.41
8,418,317 B2 * 4/2013 Wu et al. ..... 16/50
8,505,165 B2 * 8/2013 Domenig et al. ..... 16/286
2003/0200625 A1 * 10/2003 Zimmer ..... 16/306
2007/0136988 A1 * 6/2007 Bullock ..... 16/245
2008/0250604 A1 * 10/2008 Chen et al. ..... 16/225
2009/0294393 A1 * 12/2009 Chen et al. ..... 211/175

(Continued)

FOREIGN PATENT DOCUMENTS

JP 3179893 U * 11/2012
WO WO 2004020771 A1 * 3/2004

(Continued)

*Primary Examiner* — Victor Batson
*Assistant Examiner* — Jason W San
(74) *Attorney, Agent, or Firm* — Rosenberg, Klein & Lee

(57) ABSTRACT

A hinge assembly includes a hinge cup, an arm, an installation member and a damping device. The hinge cup has a receiving space and a positioning hole communicating with the receiving space. The bottom wall of the receiving space has at least one first engaging part. The arm is pivotably connected to the hinge cup. The damping device is located in the receiving space and includes a damping member, a slide and a housing. One end of the damping member is mounted in the positioning hole. The damping member has a piston rod which is connected to the slide. The housing has at least one second engaging part which is engaged with the first engaging part on the bottom wall. When the arm is moved toward a closed position relative to the hinge cup, the arm pushes the slide to provide the damping force.

10 Claims, 12 Drawing Sheets

(56) References Cited

U.S. PATENT DOCUMENTS

| | | | | |
|---|---|---|---|---|
| 2010/0072153 | A1* | 3/2010 | Chen et al. | 211/183 |
| 2010/0258986 | A1* | 10/2010 | Chen et al. | 267/124 |
| 2011/0005032 | A1* | 1/2011 | Domenig et al. | 16/54 |
| 2011/0291538 | A1* | 12/2011 | Brunnmayr | 312/326 |
| 2012/0169199 | A1* | 7/2012 | Chen et al. | 312/334.44 |
| 2012/0174338 | A1* | 7/2012 | Wu et al. | 16/297 |
| 2013/0119215 | A1* | 5/2013 | Chen et al. | 248/220.21 |
| 2013/0160242 | A1* | 6/2013 | Brunnmayr | 16/286 |

FOREIGN PATENT DOCUMENTS

| | | | |
|---|---|---|---|
| WO | WO 2007009899 | A1 * | 1/2007 |
| WO | 2012024702 | A1 | 3/2012 |
| WO | 2012024711 | A1 | 3/2012 |
| WO | 2012045102 | A1 | 4/2012 |

* cited by examiner

HINGE ASSEMBLY WITH DAMPING DEVICE

FIELD OF THE INVENTION

The present invention relates to a hinge assembly, and more particularly, to a hinge assembly with a damping device.

BACKGROUND OF THE INVENTION

U.S. 2011/0291538 A1 of Brunnmayr discloses a "Furniture Hinge". FIGS. 9a and 9b of Brunnmayr disclose a damping device 10 and a housing 10a. The housing 10a of the damping device has an outward resilient arresting element 24a. A hinge cup 6a has an opening 23a into which the resilient arresting element 24a is inserted. However, the connection simply by the resilient arresting element 24a and the opening 23a is not secure enough.

FIG. 10a of Brunnmayr discloses another installation way which has a clip-like member 24 which is engaged with an elongate recess 23a in the hinge cup 6a so that the damping device 10 is installed in the hinge cup 6. However, when the damping device 10 is hit by the hinge lever 7, the impact is directed transferred to the positioning position where the damping device 10 is installed in the hinge cup 6, the damping device 10 is easily loosened.

The present invention intends to provide a hinge assembly with a damping device which is more securely installed so as to improve the shortcomings of the conventional hinge assemblies.

SUMMARY OF THE INVENTION

The present invention relates to a hinge assembly and comprises a hinge cup having a first side wall, a second side wall, a bottom wall connected between the first and second side walls, a front wall connected between two respective front ends of the first and second side walls, and a rear wall connected between two respective rear ends of the first and second side walls. A receiving space is defined by the first and second side walls, the bottom wall, the front wall and the rear wall. The bottom wall of the receiving space has a first lug, a second lug and at least one first engaging part. An arm is pivotably connected between the first and second side walls of the hinge cup. The arm is located adjacent to the front wall of the hinge cup. An installation member is connected to the arm and installed on a piece of furniture. A damping device is located in the receiving space of the hinge cup and has a damping member, a slide and a housing. The damping member has a piston rod which is connected to the slide. The slide has at least one wing which is located corresponding to one of the first and second lugs. The housing is located in the receiving space and the damping member is accommodated in the housing. The housing has a room, an opening communicating with the room, and at least one second engaging part. The damping member extends through the room and the opening. The second engaging part is engaged with the first engaging part on the bottom wall of the hinge cup. A first resilient member is connected between the first lug and the first side wall so as to provide a force to the arm. A second resilient member is connected between the second lug and the second side wall so as to provide a force to the arm. A first pin has two ends which respectively connect the arm and the first resilient member to the hinge cup. A second pin connects the second resilient member to the hinge cup.

When the arm is located at an open position relative to the hinge cup, the at least one wing of the slide contacts one of the first and second lugs so that the slide is located at a position wherein the slide can be pushed relative to the arm.

When the arm is moved toward a close position relative to the hinge cup, the arm pushes the slide which moves the piston rod, and the at least one wing of the slide is separated from one of the first and second lugs.

Preferably, the housing has at least one slide slot and the at least one wing of the slide is linearly moved in the slide slot.

Preferably, the housing has a positioning member extending therefrom. The bottom wall of the hinge cup has an installation hole in which the positioning member is inserted.

Preferably, the housing has two covers which respectively cover the first and second resilient members.

Preferably, the slide has a recess, and the hinge cup has a stop which is engaged with the recess.

Preferably, the first side wall has a first hole and a second hole. The second side wall has a third hole, a fourth hole and a fifth hole. The first lug has a first through hole and the second lug has a second through hole. The first pin is a U-shaped pin. Two ends of the first pin extend through the first and second holes and are located in the third hole and the first through hole respectively so as to be connected to the arm and the first resilient member. The second pin is a U-shaped pin. Two ends of the second pin extend through the fourth and fifth holes. One of the two ends of the second pin extends through the second through hole and is connected with the second resilient member.

Preferably, the rear wall has a positioning hole and the damping member has an engaging portion which is engaged with the positioning hole.

Preferably, the first resilient member and the second resilient member are torsion springs.

Preferably, the housing has a reception slot which communicates with the room. The damping member has a threaded portion, a guide portion and an adjustment member. The damping member is linearly movable in the room. The adjustment member is located in the reception slot of the housing and is movably and threadedly connected to the threaded portion. The adjustment member is partially exposed from the reception slot of the housing.

Preferably, the hinge cup has a guide groove and a positioning hole, wherein the guide groove is located in the bottom wall of the hinge cup and substantially perpendicular to the rear wall of the hinge cup. The positioning hole is located in the rear wall of the hinge cup. The guide portion of the damping member extends through the guide groove so that the damping member is linearly movable relative to the hinge cup. The threaded portion of the damping member partially extends through the positioning hole.

One aspect of the present invention is to provide a hinge assembly with a damping device, wherein the damping device is securely mounted on the hinge cup of the hinge assembly.

Another aspect of the present invention is to provide a hinge assembly with a damping device, wherein the travel of the damping device is adjustable.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
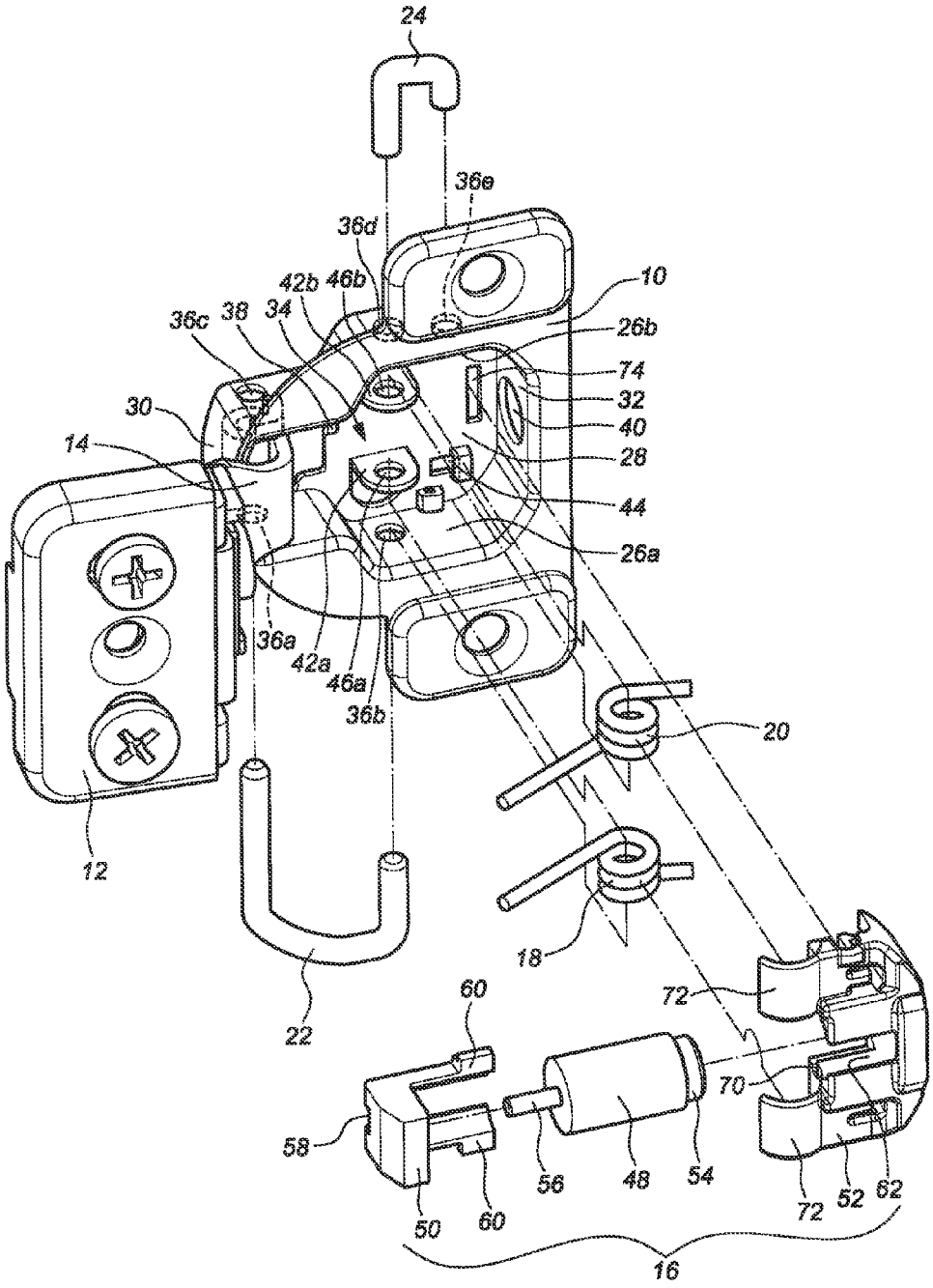
FIG. 1 is an exploded view to show the first embodiment of the damping device and the hinge assembly of the present invention.
Figure 2:
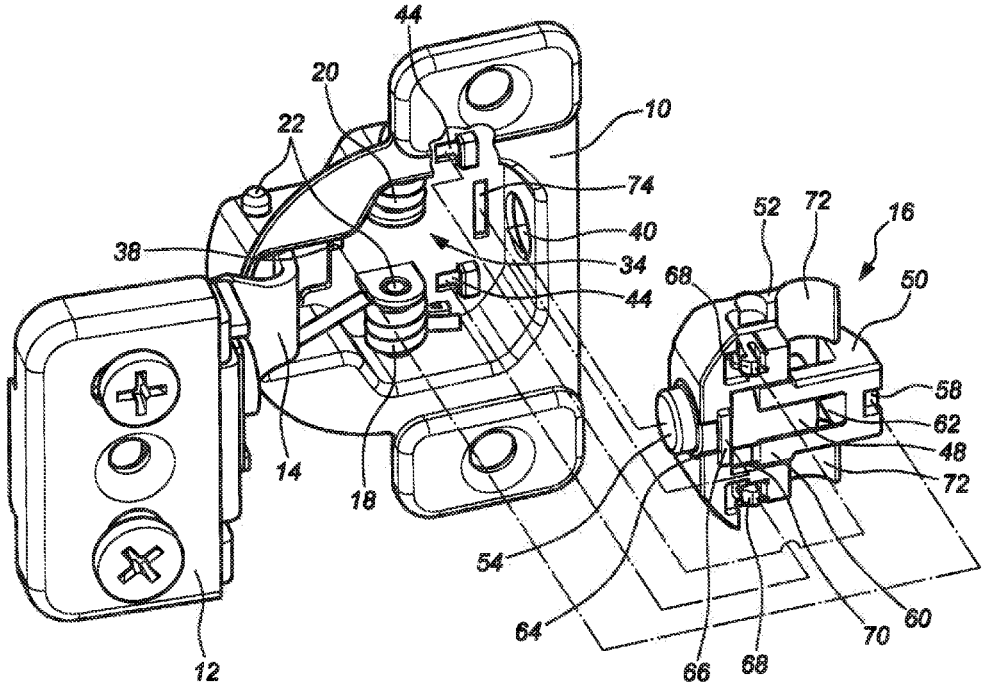
FIG. 2 shows the first embodiment of the assembled damping device and the hinge assembly of the present invention.
Figure 3:
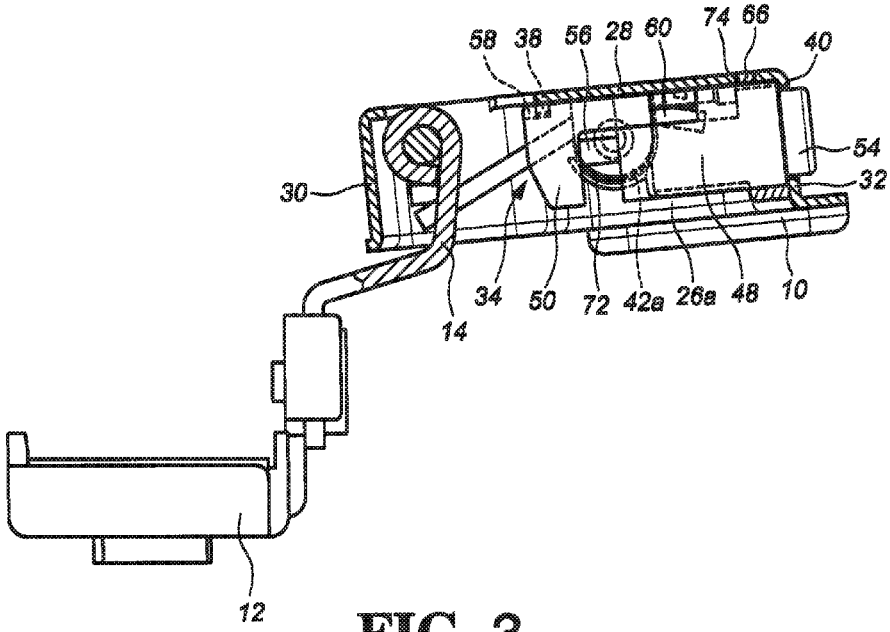
FIG. 3 is a partial cross sectional view of the first embodiment of the hinge assembly of the present invention.

Referring to FIGS. 1 to 3, the hinge assembly of the present invention comprises a hinge cup 10, an installation member 12, an arm 14 connected between the hinge cup 10 and the installation member 12, a damping device 16 connected to the hinge cup 10, a first resilient member 18 and a second resilient member 20 connected to the hinge cup 10, a first pin 22 connected to the arm 14 and the first resilient member 18, and a second pin 24 connected to the second resilient member 20. The first and second resilient members 18, 20 respectively provide a first force and a second force to the arm 14. The damping device 16 provides a damping force to the arm 14.

The hinge cup 10 comprises a first side wall 26*a*, a second side wall 26*b*, a bottom wall 28 which is connected between the first and second side walls 26*a*, 26*b*, a front wall 30 connected between two respective front ends of the first and second side walls 26*a*, 26*b*, and a rear wall 32 connected between two respective rear ends of the first and second side walls 26*a*, 26*b*. A receiving space 34 is defined by the first and second side walls 26*a*, 26*b*, the bottom wall 28, the front wall 30 and the rear wall 32. The first side wall 26*a* has a first hole 36*a* and a second hole 36*b*, and the second side wall 26*b* has a third hole 36*c*, a fourth hole 36*d* and a fifth hole 36*e*. The bottom wall 28 has a stop 38 located adjacent to the front wall 30, and the rear wall 32 has a positioning hole 40. The bottom wall 28 further has a first lug 42*a*, a second lug 42*b* and at least one or two first engaging parts 44. The first lug 42*a* has a first through hole 46*a*, and the second lug 42*b* has a second through hole 46*b*.

The installation member 12 is connected to the arm 14 and installed on a piece of furniture such as a cabinet.

The arm 14 is pivotably connected between the first and second side walls 26*a*, 26*b* of the hinge cup 10. The arm 14 is located adjacent to the front wall 30 of the hinge cup 10.

The damping device 16 is located in the receiving space 34 of the hinge cup 10 and comprises a damping member 48, a slide 50 and a housing 52. The damping member 48 has an engaging portion 54 on the rear end thereof, and the engaging portion 54 is engaged with the positioning hole 40 of the rear wall 32 as shown in FIG. 3. The damping member 48 has a piston rod 56 on the front end thereof, and the piston rod 56 is connected to the slide 50. Preferably, the slide 50 has a recess 58, and the stop 38 of the hinge cup 10 is engaged with the recess 58 to temporarily position the slide 50. The slide 50 has two wings 60 which are located corresponding to the first and second lugs 42*a*, 42*b*. Preferably, the two wings 60 are in contact with the first and second lugs 42*a*, 42*b* to temporarily position the slide 50. The housing 52 is located in the receiving space 34 and the damping member 48 is accommodated in the housing 52. The housing 52 covers the first and second resilient members 18, 20. The housing 52 has a room 62, an opening 64 communicating with the room 62, a positioning member 66, at least one or two second engaging parts 68, two slide slots 70 and two covers 72. The damping member 48 extends through the room 62 and the opening 64, and the engaging portion 54 extends through the opening 64. The bottom wall 28 of the hinge cup 10 has an installation hole 74 in which the positioning member 66 is inserted. The at least one second engaging part 68 is engaged with the at least one first engaging part 44 on the bottom wall 28 of the hinge cup 10. The slide slots 70 allow the wings 60 of the slide 50 to move linearly.

Figure 4:
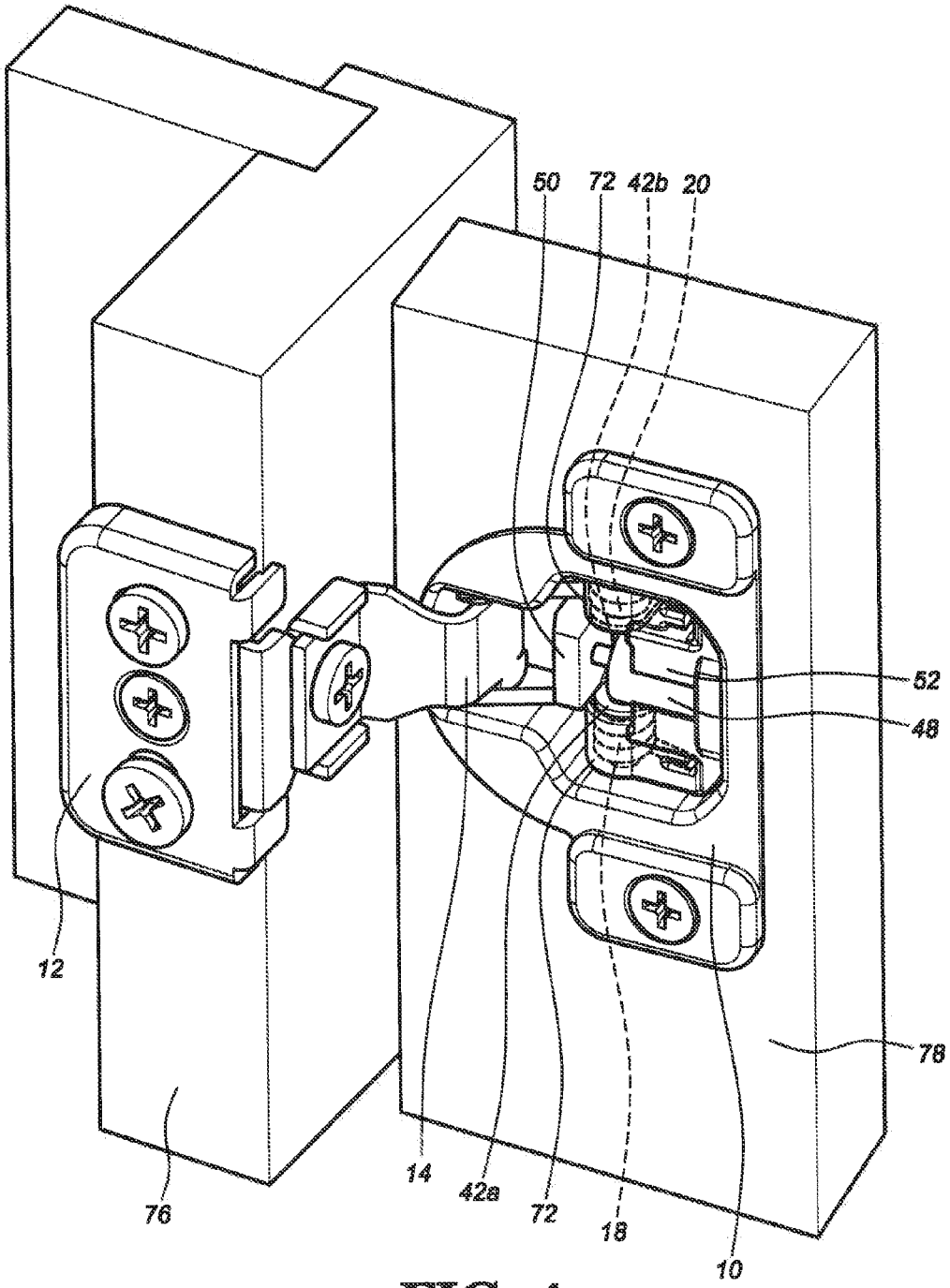
FIG. 4 shows that the first embodiment of the hinge assembly of the present invention is connected between the cabinet and the door.

The first resilient member 18 is connected between the first lug 42*a* and the first side wall 26*a*. Preferably, the first resilient member 18 is a torsion spring pivotably connected to the first lug 42*a* and is covered by the cover 72 of the housing 52 as shown in FIG. 4.

The second resilient member 20 is connected between the second lug 42*b* and the second side wall 26*b*. Preferably, the second resilient member 20 is a torsion spring pivotably connected to the second lug 42*b* and is covered by the cover 72 of the housing 52 as shown in FIG. 4.

The first pin 22 is a U-shaped pin. Two ends of the first pin 22 extend through the first and second holes 36*a*, 36*b* and are located in the third hole 36*c* and the first through hole 46*a* respectively so as to be connected to the arm 14 and the first resilient member 18. The first resilient member 18 provides a first force to the arm 14.

The second pin 24 is a U-shaped pin. Two ends of the second pin 24 extend through the fourth and fifth holes 36*d*, 36*e*, one of the two ends of the second pin 24 extends through the second through hole 46*b* and is connected with the second resilient member 20. The second resilient member 20 provides a second force to the arm 14.

Figure 5:
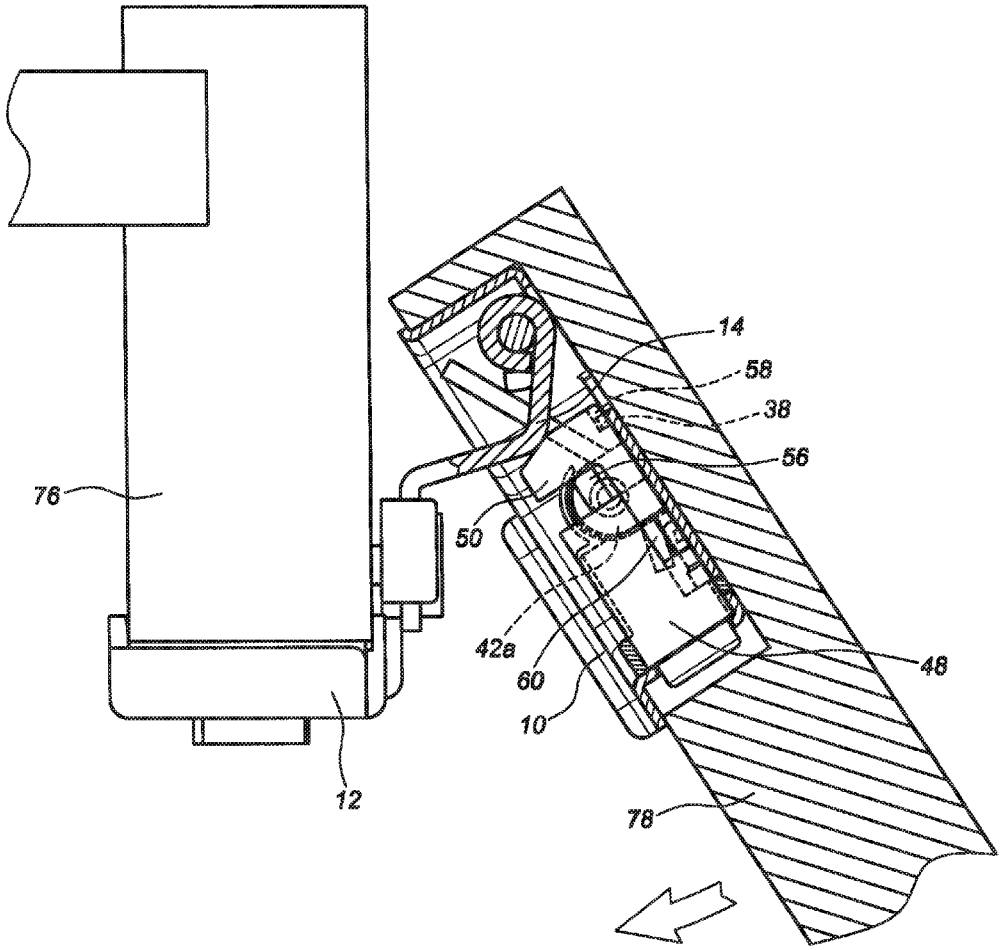
FIG. 5 shows that the door is pivoted toward the cabinet, and the arm is in contact with the slide under the first embodiment of the present invention.
Figure 6:
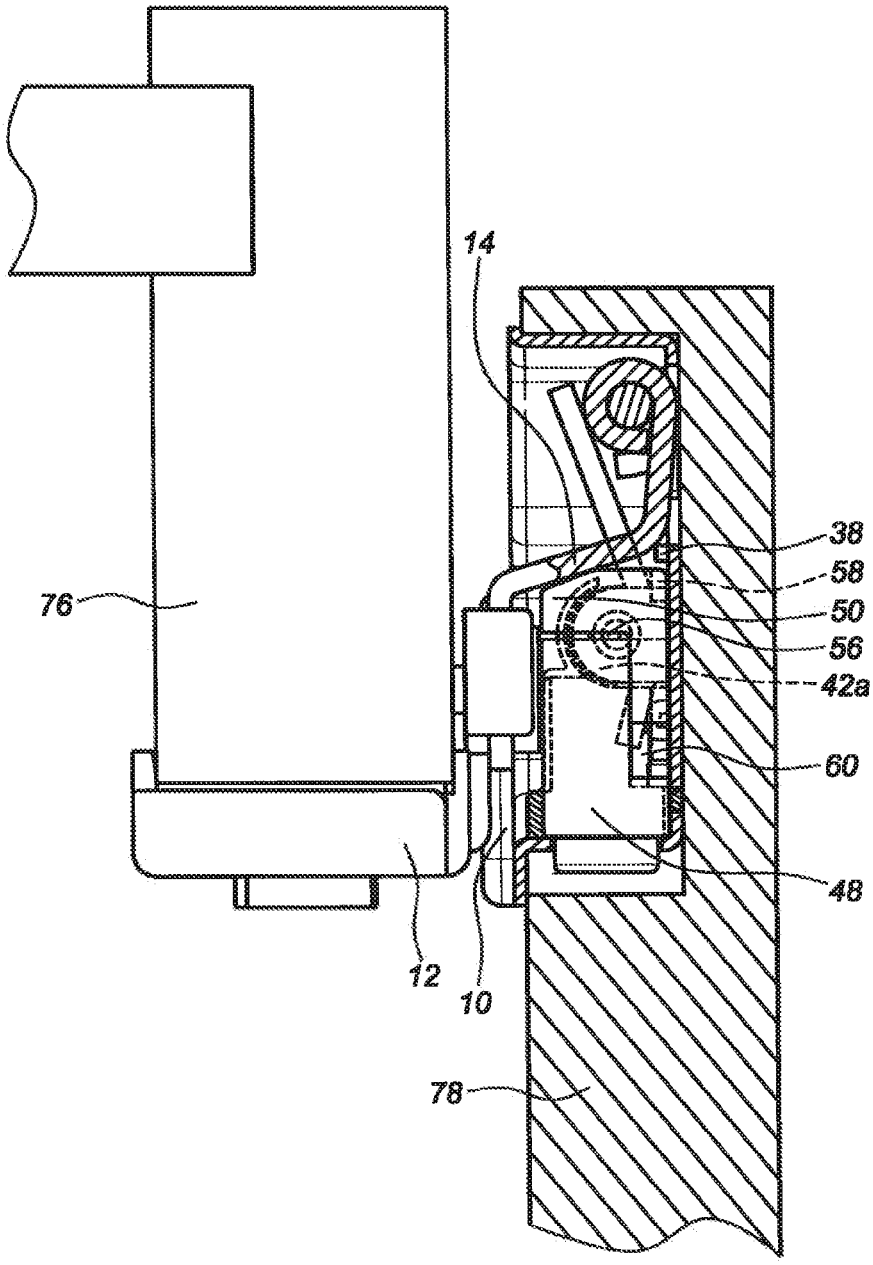
FIG. 6 shows the status of the first embodiment of the hinge assembly of the present invention when the door is at the closed position relative to the cabinet.

As shown in FIG. 4, the installation member 12 is installed to the cabinet 76, and the hinge cup 10 is connected to the door 78. When the door 78/arm 14 is moved toward a closed position relative to the cabinet 76/hinge cup 10 (shown in FIGS. 5 and 6), the arm 14 pushes the slide 50 which moves the piston rod 56 to slowly retract into the damping member 48 to have a damping function. Therefore, the door 78 is slowly and quietly closed to the cabinet 76. In the meanwhile, the wings 60 of the slide 50 are separated from the first and second lugs 42*a*, 42*b* (FIG. 6 shows that one of the wings 60 is separated from the first lug 42*a*), and the stop 38 of the hinge cup 10 is moved away from the recess 58 of the slide 50.

Figure 7:
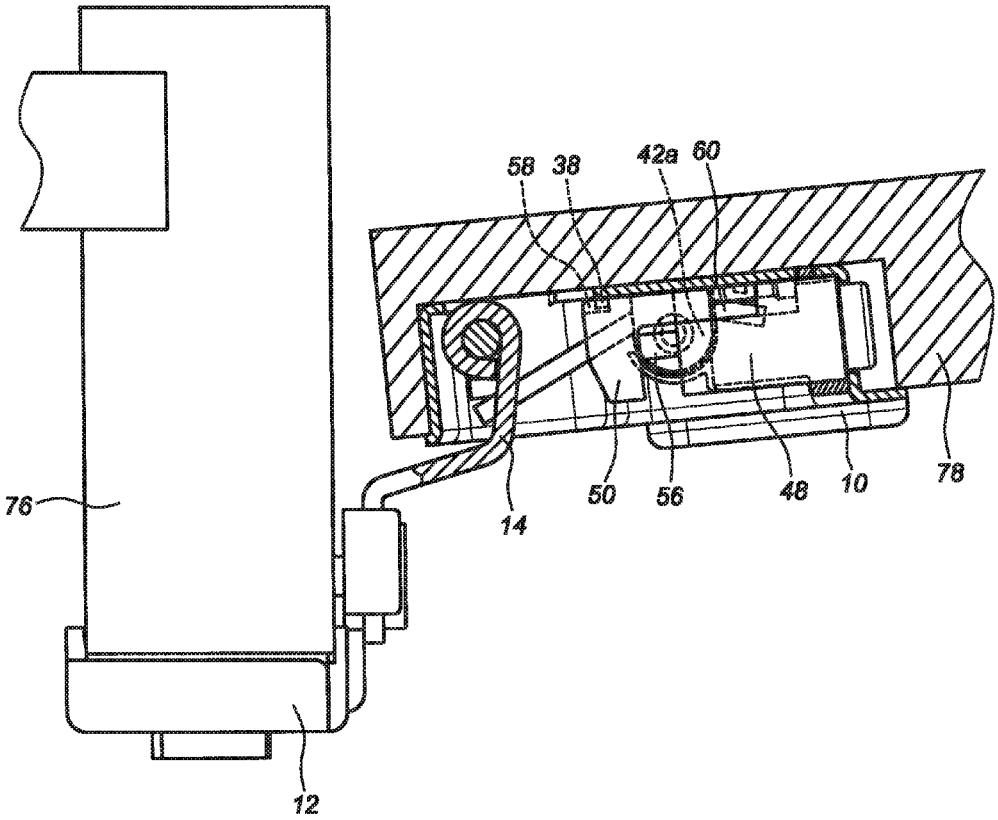
FIG. 7 shows the status of the first embodiment of the hinge assembly of the present invention when the door is at the open position relative to the cabinet.

As shown in FIG. 7, when the arm 14 is spread out relative to the hinge cup 10 at an open position, the piston rod 56 of the damping member 48 extends and moves the slide 50 until the wings 60 of the slide 50 contact the first and second lugs 42*a*, 42*b* (the drawing shows that one of the wings 60 contacts the first lug 42*a*). Simultaneously, the stop 38 of the hinge cup 10 is engaged with the recess 58 of the slide 50, so that the slide 50 is located at a position wherein the slide 50 can be pushed relative to the arm 14 to generate the damping function.

The damping device 16 is installed to the hinge cup 10 by the configuration that the engaging portion 54 of the damping member 48 extends through the opening 64 of the housing 52 and is engaged with the positioning hole 40 of the rear wall 32. Further, the at least one second engaging part 68 of the housing 52 is engaged with the first engaging part 44 on the bottom wall 28 of the hinge cup 10 so as to position the damping device 16 to the hinge cup 10. During the damping process, the wings 60 of the slide 50 are linearly movable in the slide slots 70 of the housing 52 so as to provide smooth and stable damping force. Accordingly, when the arm 14 contacts the slide 50 or when the arm 14 is closing toward the hinge cup 10, the damping device 16 provides stable damping travel.

Figure 8:
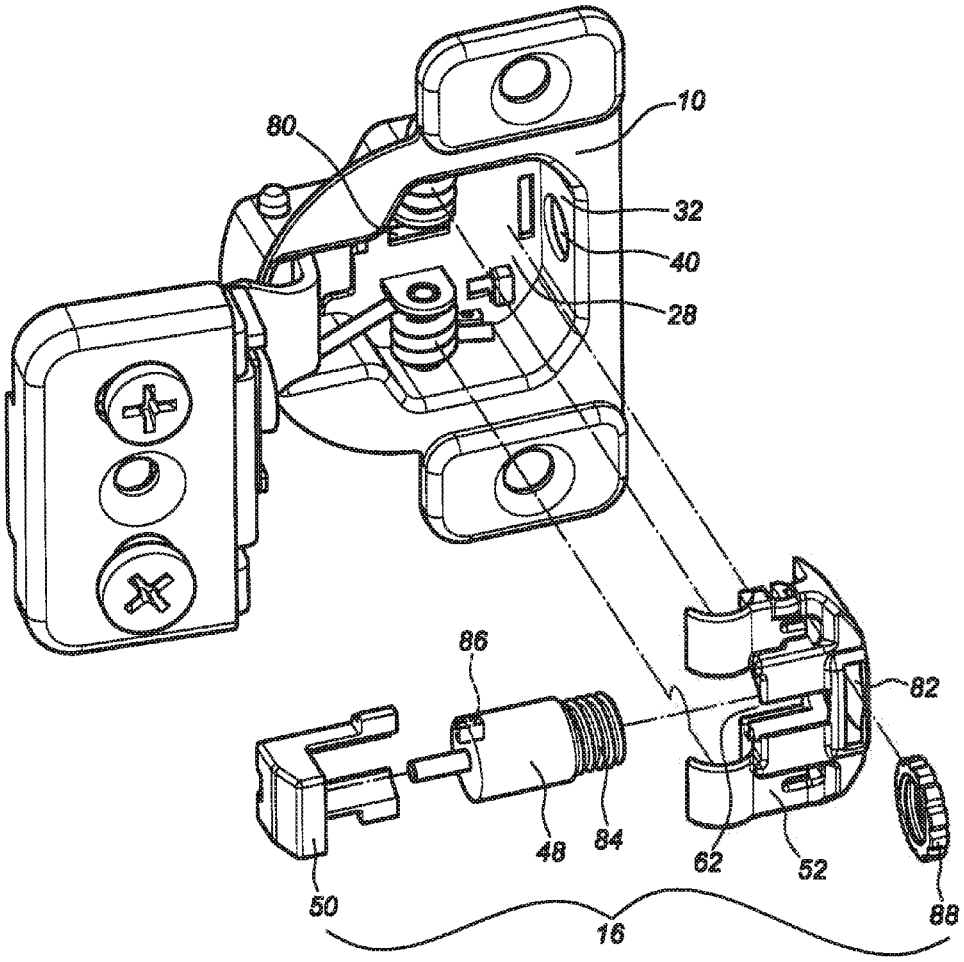
FIG. 8 is an exploded view to show the second embodiment of the damping device of the present invention.
Figure 9:
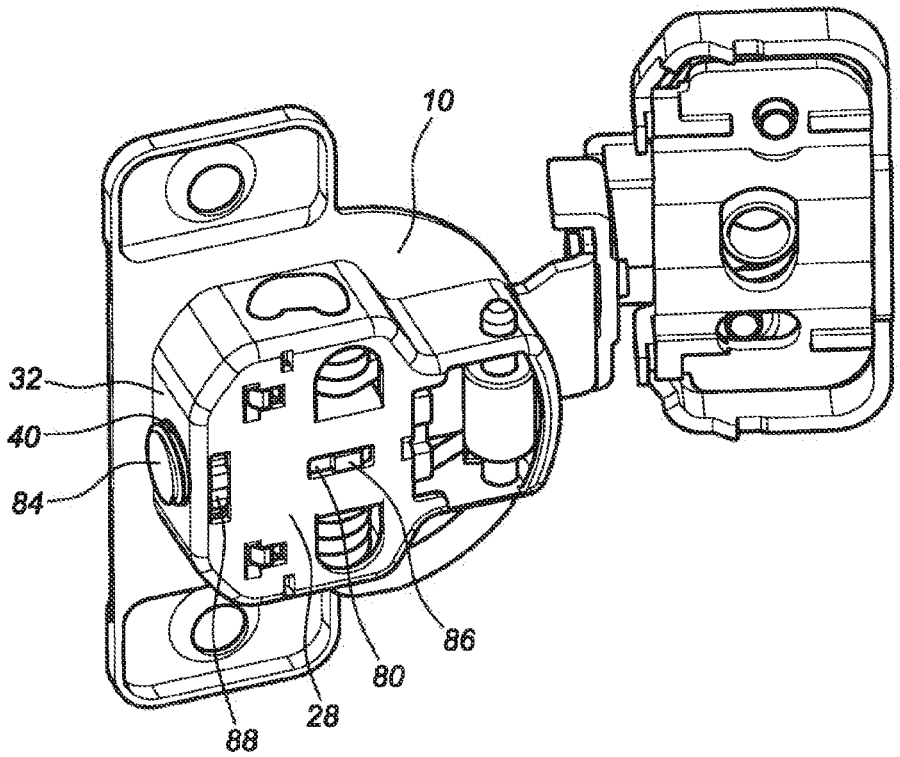
FIG. 9 is a perspective view to show the second embodiment of the hinge assembly with the damping device of the present invention.

It is noted that the travel distance of the damping device 16 can be adjustable. As shown in FIGS. 8 and 9, in another embodiment, the hinge cup 10 has a guide groove 80. The guide groove 80 is located in the bottom wall 28 of the hinge cup 10 and substantially perpendicular to the rear wall 32 of the hinge cup 10. The housing 52 has a reception slot 82 which communicates with the room 62. The damping member 48 has a threaded portion 84, a guide portion 86 and an adjustment member 88. The threaded portion 84 is located corresponding to the positioning hole 40 of the rear wall 32 of the hinge cup 10. The threaded portion 84 of the damping member 48 partially extends through the positioning hole 40. The guide portion 86 extends through the guide groove 80, so that the damping member 48 is linearly movable relative to the hinge cup 10. The adjustment member 88 is located in the reception slot 82 of the housing 52 and is movably and threadedly connected to the threaded portion 84. The adjustment member 88 is partially exposed from the reception slot 82 of the housing 52. By this way, the damping member 48 is linearly movable linearly in the room 62.

Figure 10:
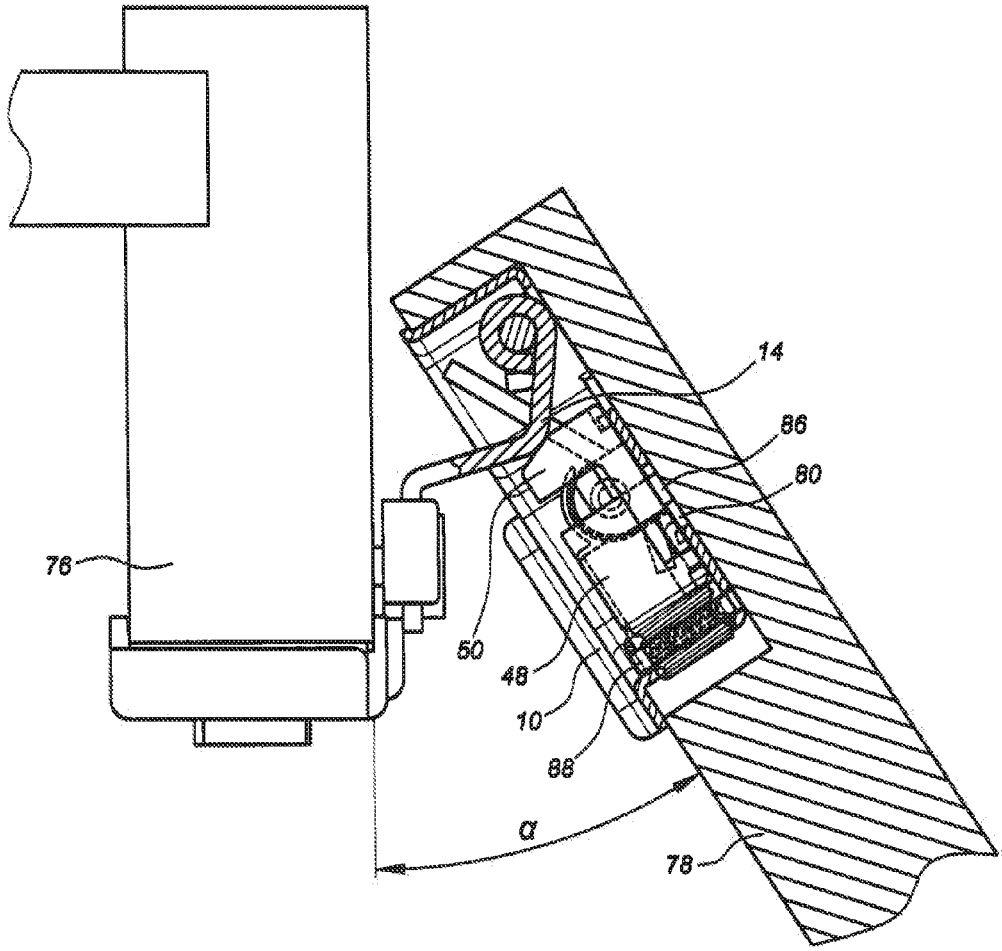
FIG. 10 shows that the second embodiment of the damping member is adjusted to the first position.
Figure 11:
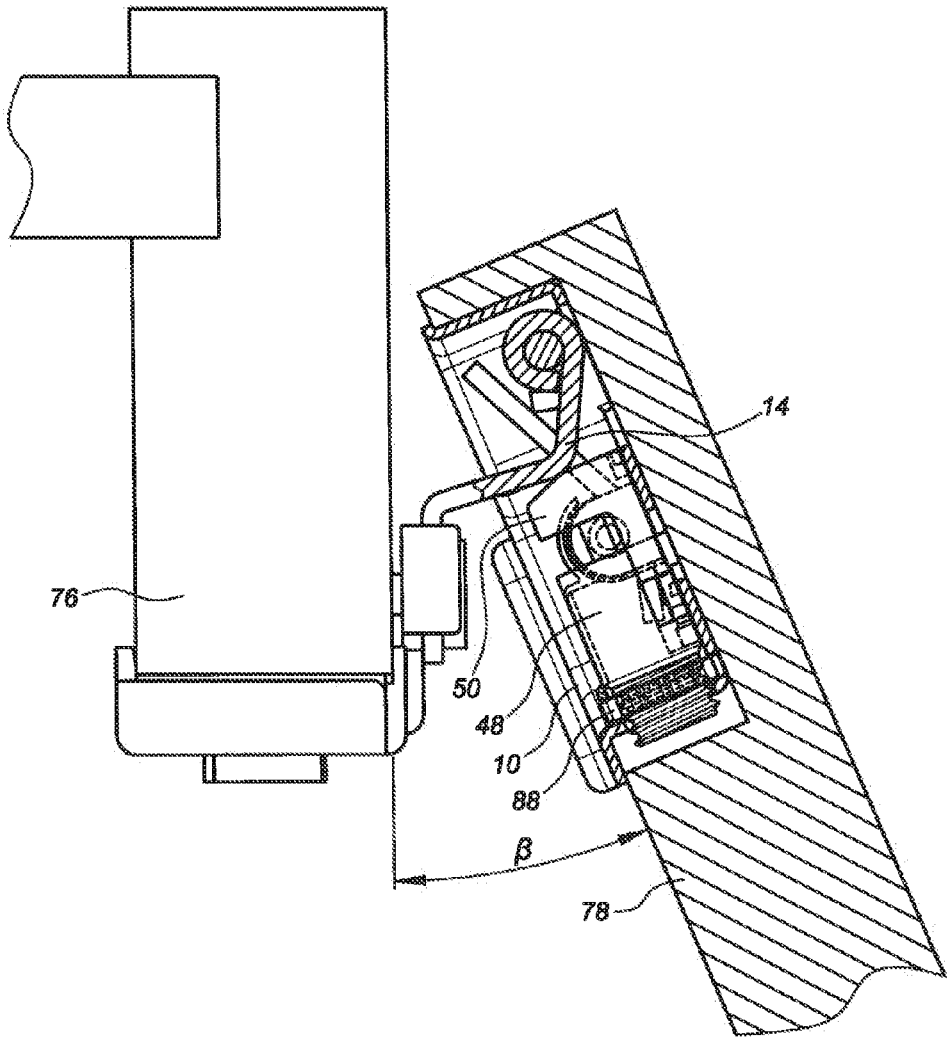
FIG. 11 shows that the second embodiment of the damping member is adjusted to the second position.

As shown in FIGS. 10 and 11, when the adjustment member 88 is rotated in a certain rotating direction, the damping member 48 moves to a first position relative to the hinge cup 10 in response to the rotation of the adjustment member 88, so that relative position of the slide 50 to the arm 14 can also be changed. Consequently, the impact angle, the arm 14 hits the slide 50 to generate the damping function when the arm 14 is pivoted to close the hinge cup 10, can be adjusted. The damping function is executed when the door 78 is located at the angle $\alpha$ relative to the cabinet 76 (as FIG. 10 shown), so that the door 78 is slowly and quietly closed within the range of the angle $\alpha$. When the adjustment member 88 is further rotated in the certain rotating direction, the damping member 48 moves to a second position relative to the hinge cup 10 (as FIG. 11 shown), the arm 14 is pivoted toward the cabinet 76, the impact angle is changed from the angle $\alpha$ to angle $\beta$. Therefore, when the door 78 is being closed toward the cabinet 76 and the angle therebetween is within the range of the angle $\beta$, the damping function is executed so that the door 78 is slowly and quietly closed within the range of the angle $\beta$.

Figure 12:
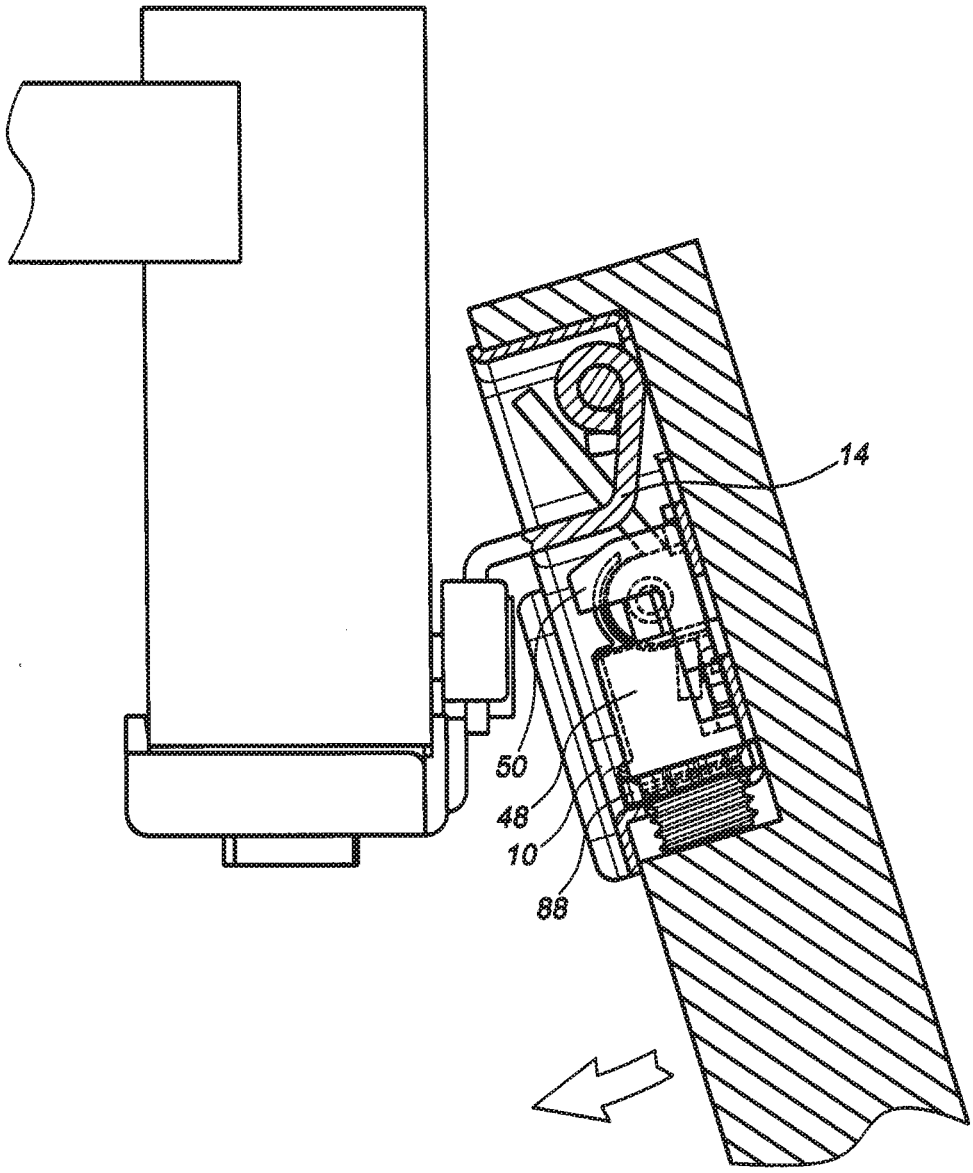
FIG. 12 shows that the second embodiment of the damping member is adjusted to the third position to shut off the damping function.

As shown in FIG. 12, the damping function 16 is shut off when the adjustment member 88 is rotated to move the damping member 48 to a third position relative to the hinge cup 10. Wherein, the slide 50 is moved away from the arm 14, so that when the arm 14 is located at the complete closed position relative to the hinge cup 10, the arm 14 does not touch the slide 50.

While we have shown and described the embodiment in accordance with the present invention, it should be clear to those skilled in the art that further embodiments may be made without departing from the scope of the present invention.

What is claimed is:

1. A hinge assembly comprising:

a hinge cup adapted to be installed on a cabinet door having a first side wall, a second side wall, a bottom wall which is connected between the first and second side walls, a front wall connected between two respective front ends of the first and second side walls, and a rear wall connected between two respective rear ends of the first and second side walls, a receiving space being defined by the first and second side walls, the bottom wall, the front wall and the rear wall, the bottom wall of the receiving space having a first lug, a second lug and at least one first engaging part;

an arm pivotably connected between the first and second side walls of the hinge cup, the arm located adjacent to the front wall of the hinge cup;

an installation member connected to the arm and adapted to be installed on a piece of cabinet furniture;

a damping device located in the receiving space of the hinge cup and having a damping member, a slide, and a housing, the damping member having a piston rod which is connected to the slide, the slide having at least one wing which is located corresponding to one of the first and second lugs, the housing located in the receiving space and the damping member being accommodated in the housing, the housing having a room, an opening communicating with the room, and at least one second engaging part, the damping member extending through the room and the opening, the second engaging part engaged with the first engaging part on the bottom wall of the hinge cup;

a first resilient member connected between the first lug and the first side wall so as to provide a force to the arm;

a second resilient member connected between the second lug and the second side wall so as to provide a force to the arm;

a first pin having two ends laterally spaced one from the other which respectively connect the arm and the first resilient member to the hinge cup;

a second pin connecting the second resilient member to the hinge cup;

when the arm is located at an open position relative to the hinge cup, the at least one wing of the slide contacts one of the first and second lugs to temporarily position the slide, and when the arm is moved toward a closed position relative to the hinge cup, the arm pushes the slide which moves the piston rod to provide a damping function, the at least one wing of the slide is separated from one of the first and second lugs.

2. The hinge assembly as claimed in claim 1, wherein the housing has at least one slide slot, and the at least one wing of the slide is linearly moved movable in the slide slot.

3. The hinge assembly as claimed in claim 1, wherein the housing has a positioning member extending therefrom, the bottom wall of the hinge cup has an installation hole in which the positioning member is inserted.

4. The hinge assembly as claimed in claim 1, wherein the housing has two covers which respectively cover the first and second resilient members.

5. The hinge assembly as claimed in claim 1, wherein the slide has a recess, and the hinge cup has a stop which is engaged with the recess.

6. The hinge assembly as claimed in claim 1, wherein the first side wall has a first hole and a second hole, the second side wall has a third hole, a fourth hole and a fifth hole, the first lug has a first through hole and the second lug has a second through hole, the first pin is a U-shaped pin, two ends of the first pin extend through the first and second holes and located in the third hole and the first through hole respectively so as to be connected to the arm and the first resilient member, the second pin is a U-shaped pin, two ends of the second pin extend through the fourth and fifth holes, one of the two ends of the second pin extending through the second through hole and connected with the second resilient member.

7. The hinge assembly as claimed in claim 1, wherein the rear wall has a positioning hole, and the damping member has an engaging portion which is engaged with the positioning hole.

8. The hinge assembly as claimed in claim 1, wherein the first resilient member and the second resilient member are torsion springs.

9. The hinge assembly as claimed in claim 1, wherein the housing has a reception slot which communicates with the room, the damping member has a threaded portion, a guide portion and an adjustment member, the damping member is linearly movable in the room, the adjustment member is located in the reception slot of the housing and is movably and threadedly connected to the threaded portion, and the adjustment member is partially exposed from the reception slot of the housing, thereby the position of the damping member relative to the hinge cup is selectively adjustable by rotating the adjustment member.

10. The hinge assembly as claimed in claim 9, wherein the hinge cup has a guide groove and a positioning hole, the guide groove is located in the bottom wall of the hinge cup and substantially perpendicular to the rear wall of the hinge cup, the positioning hole is located in the rear wall of the hinge cup, the guide portion of the damping member extends through the guide groove so that the damping member is linearly movable relative to the hinge cup, and the threaded portion of the damping member partially extends through the positioning hole.

* * * * *